US009415255B2

(12) United States Patent
McClellan

(10) Patent No.: US 9,415,255 B2
(45) Date of Patent: Aug. 16, 2016

(54) OFF-SET WEIGHTED EXERCISE METHOD AND APPARATUS

(71) Applicant: Shelley McClellan, Scottsdale, AZ (US)

(72) Inventor: Shelley McClellan, Scottsdale, AZ (US)

( * ) Notice: Subject to any disclaimer, the term of this patent is extended or adjusted under 35 U.S.C. 154(b) by 0 days.

(21) Appl. No.: 14/452,295

(22) Filed: Aug. 5, 2014

(65) Prior Publication Data

US 2014/0349819 A1 Nov. 27, 2014

Related U.S. Application Data

(63) Continuation of application No. 13/263,839, filed as application No. PCT/US2010/030787 on Apr. 12, 2010, now Pat. No. 8,795,142.

(60) Provisional application No. 61/168,473, filed on Apr. 10, 2009.

(51) Int. Cl.
*A63B 21/00* (2006.01)
*A63B 21/065* (2006.01)

(52) U.S. Cl.
CPC ..... *A63B 21/065* (2013.01); *A63B 21/00072* (2013.01); *A63B 21/4005* (2015.10); *A63B 21/4009* (2015.10)

(58) Field of Classification Search
CPC ..... A63B 21/00
USPC ..... 482/124, 105
See application file for complete search history.

(56) References Cited

U.S. PATENT DOCUMENTS 4,714,247 A * 12/1987 Gerstung ..... 482/23
2006/0229173 A1* 10/2006 Foley ..... 482/105

* cited by examiner

*Primary Examiner* — Jerome W Donnelly
(74) *Attorney, Agent, or Firm* — Peter B. Scull; Hamilton, DeSanctis & Cha, LLP

(57) ABSTRACT

Disclosed is an adjustable weighted exercise apparatus which in one implementation may include a base frame assembly attachable to a strap assembly for connection to a user, the base frame assembly including a base frame; a weight support member connected to the base frame and disposed to maintain a weight at a distance from the user. In some implementations, the weight support member may be further connected to at least one support bar connected to the base frame. A method hereof may include enhancing exercise of a body including disposing a weight at a distance from a user's body; and, exercising the user's body.

19 Claims, 8 Drawing Sheets

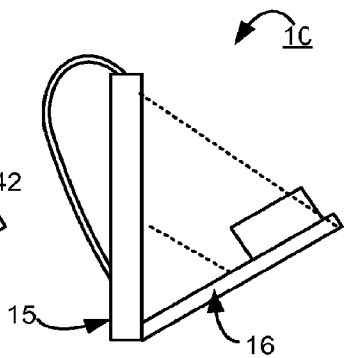
Fig. 7a
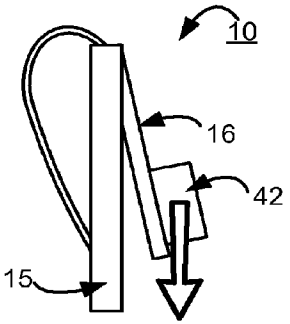
Fig. 7b
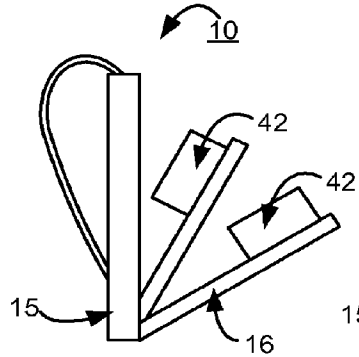
Fig. 8a
Fig. 8b
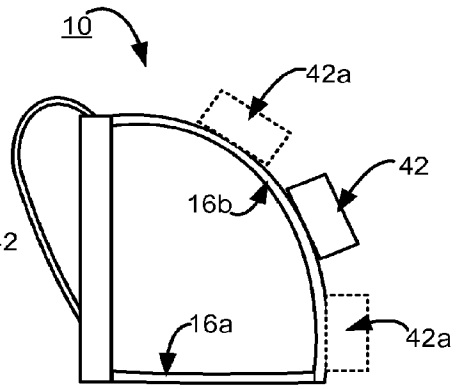
Fig. 9b
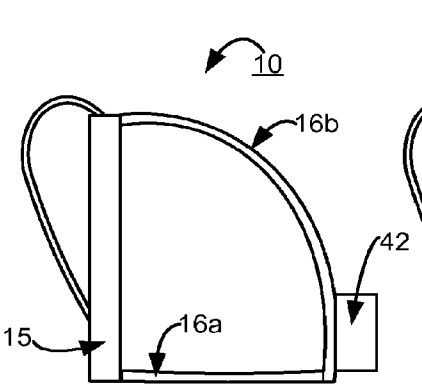
Fig. 9a
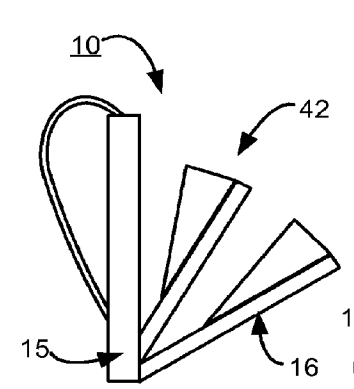
Fig. 10
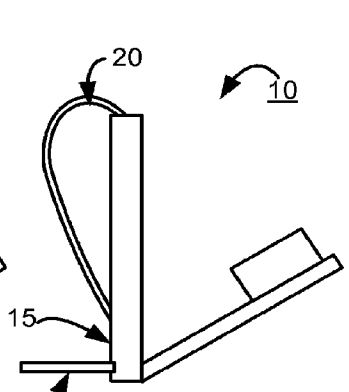
Fig. 11

OFF-SET WEIGHTED EXERCISE METHOD AND APPARATUS

CROSS REFERENCE TO RELATED APPLICATION

This application claims the benefit of priority under 35 U.S.C. §119(e) from U.S. Provisional Patent Application No. 61/168,473, entitled "Adjustable Weighted Back Pack for Therapeutic or Performance Based Exercise," filed Apr. 10, 2009, which is incorporated herein in its entirety by this reference for all that it teaches and discloses.

BACKGROUND

Weighted vests have been introduced for increasing a load during therapeutic or performance based exercise. Added weight during an exercise program increases a user's heart rate and places greater demand on a user's muscles and bones. The benefits of these apparatuses include increased cardio function, improved body mass index, increased strength, and improved bone density. Weighted vests allow the user to complete functional tasks such as walking and balancing with increased weight, thereby strengthening the user and allowing the user to perform these tasks with more ease under non-weighted conditions.

SUMMARY

Disclosed is an adjustable weighted exercise apparatus which in one implementation may include a base frame assembly attachable to a strap assembly for connection to a user, the base frame assembly including a base frame; a weight support member connected to the base frame and disposed to maintain a weight at a distance from the user. In some implementations, the weight support member may be further connected to at least one support bar connected to the base frame. A method hereof may include enhancing exercise of a body including disposing a weight at a distance from a user's body; and, exercising the user's body.

The foregoing specific aspects and advantages of the present developments are illustrative of those which can be achieved by these developments and are not intended to be exhaustive or limiting of the possible advantages which can be realized. Thus, those and other aspects and advantages of these developments will be apparent from the description herein or can be learned from practicing the disclosure hereof, both as embodied herein or as modified in view of any variations which may be apparent to those skilled in the art. Thus, in addition to the exemplary aspects and implementations described above, further aspects and implementations will become apparent by reference to and by study of the following descriptions.

BRIEF DESCRIPTION OF THE DRAWINGS

In the drawings:

FIG. 7, which includes sub-part FIGS. 7*a* and 7*b*, provides side elevational views of an implementation hereof;

FIG. 8, which includes sub-part FIGS. 8*a* and 8*b*, provides side elevational views of an alternative implementation hereof;

FIG. 9, which includes sub-part FIGS. 9*a* and 9*b*, provides side elevational views of another alternative implementation hereof;

FIG. 10 provides a side elevational view of another alternative implementation hereof;

FIG. 11 provides a side elevational view of another alternative implementation hereof; and, FIG. 12 provides a method according hereto.

DETAILED DESCRIPTION

The present disclosure relates to an adjustable weighted backpack method and apparatus typically configured to provide a weight disposed at a distance from the user's body; the weight in some implementations providing a directed pressure on the mid body creating increased core muscle recruitment when used for therapeutic or performance based exercise.

There is currently a trend in both rehabilitation and performance based exercise to strengthen the core musculature including the abdominals and gluteals. Conventional weighted vests provide weight distribution on all sides of a user's core area or trunk such that the user experiences joint compression similar to a person who has gained weight. Contrarily, a weighted pack with an unequal distribution of weight between the posterior and the anterior of the body can cause a shift in the center of gravity of the person thereby creating a muscular reaction to maintain balance in static standing exercises and in dynamic functional activities. An adjustable weighted backpack with a weight force disposed away from the body allows the user to focus on the core musculature or other desired muscle groups while completing exercise regimens. When the weight of the backpack is positioned at a distance from the posterior of the user, the abdominals and other core and other muscles must work to maintain balance. The muscular demand increases with other changes such as positioning of the body, for example bent slightly forward or backward at the hips, or with changes of the walking surface e.g., uphill or downhill.

The developments hereof relate to an adjustable weighted backpack apparatus typically configured to provide a weight disposed at or worn at a distance away from the user's body. This may provide a directed pressure on the body creating increased muscle recruitment when used for therapeutic or performance based exercise. The present development allows the wearer of the apparatus to wear the weight disposed at a distance away from the body to cause the muscles to have pressure applied at different angles thus causing contractions of the core and other muscles of the body to maintain balance. Additionally, wearing the apparatus simultaneously increases the weight bearing capacity of the muscles involved in any of the exercises performed.

Figure 1:
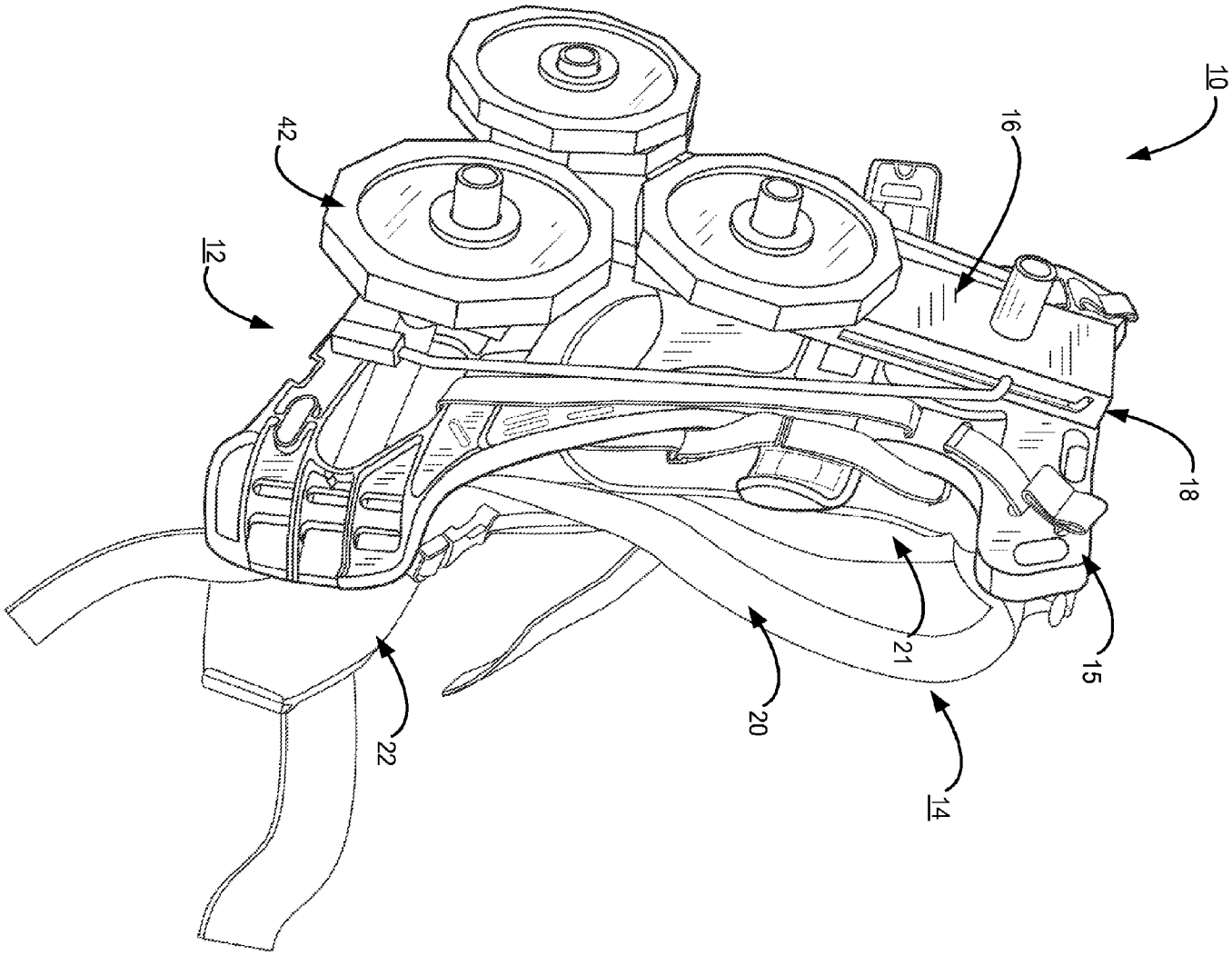
FIG. 1 provides an isometric view of an entire exercise assembly hereof including a frame, a backpack assembly, and a rotatable weight supporting member.

As generally shown in FIG. 1, an implementation of a adjustably weighted exercise apparatus 10, as such may typically be used in therapeutic and/or performance based exercise, may have a frame sub-assembly 12 connectable or connected, as shown here, to a backpack sub-assembly 14. The frame sub-assembly 12 may have a weight support member 16 which is mounted on the frame 15. In this implementation the weight support member is rotatable and ins connected to the frame member 15 by a hinge 18 (shown better in FIG. 4). The backpack sub-assembly 14 may have a shoulder harness 20 and a lumbar support harness 22 attached to a body portion 21 which allows the user to securely attach the entire adjustable weighted backpack assembly 10 to the user's body (note, it may be in some implementations that one or more straps are attached directly to the frame 15).

Figure 2A:
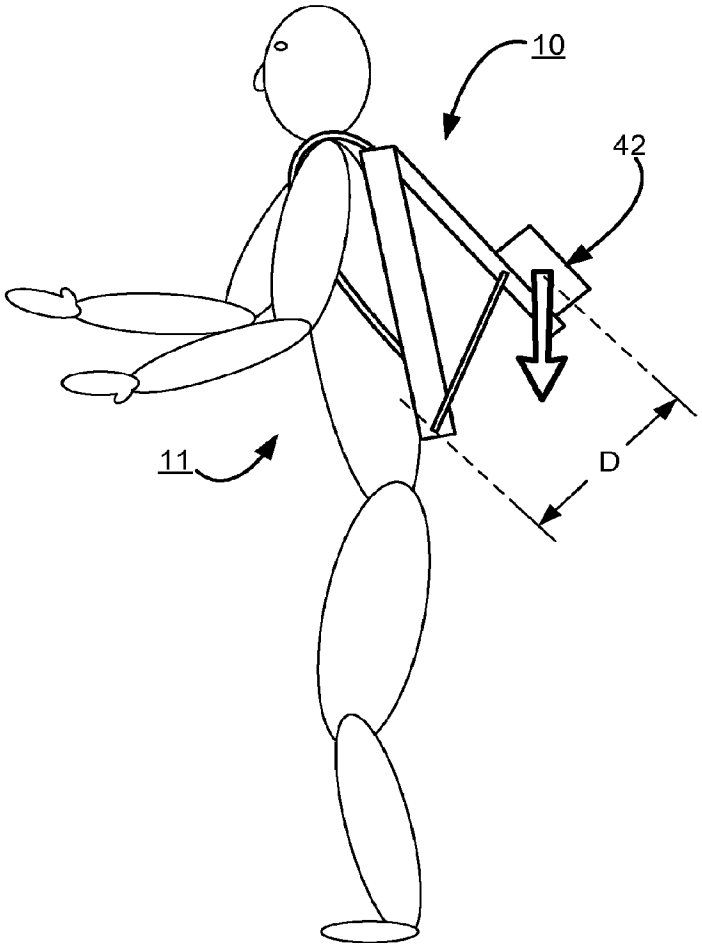
FIG. 2, which includes sub-part FIGS. 2*a* and 2*b*, provides side elevational views of an implementation hereof in use.
Figure 2B:
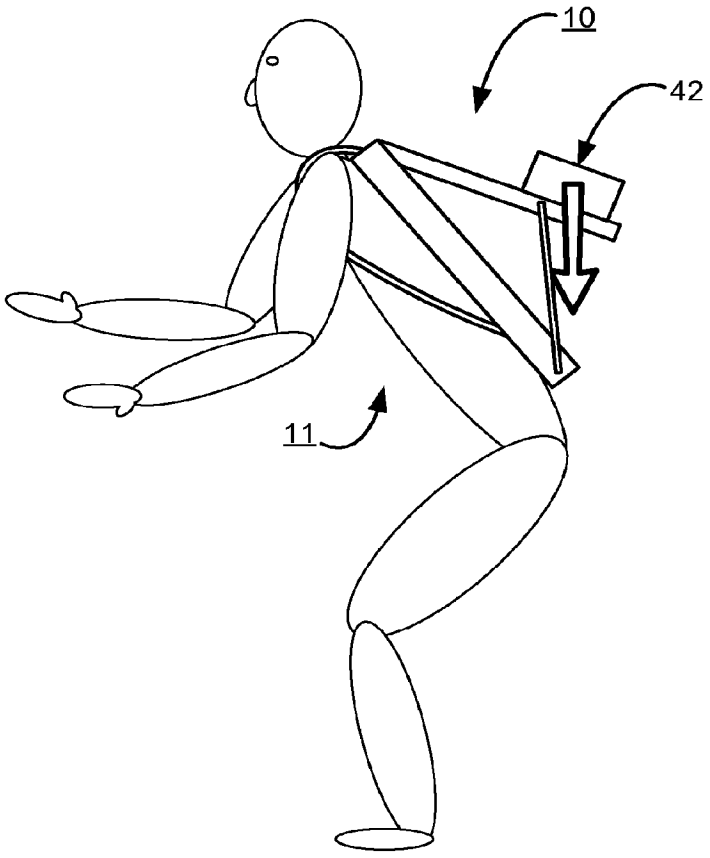
Figure 12:
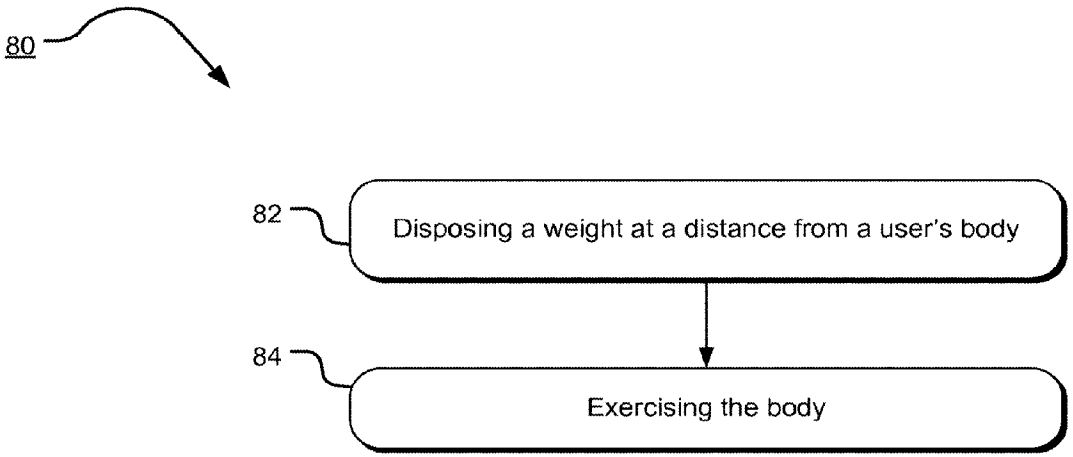

As shown in FIG. 2, a user 11 may have an apparatus 10 attached for use. The Apparatus 10 maintains the weight 42 at a distance D from the user. In one simplified form, a method hereof, see method 80 of FIG. 12, may include disposing the weight on a user with a distance set thereby, per operation 82, and then exercising the user, per operation 84. A backpack is adjustable to fit snuggly upon the hips at the anterior superior ilium. The shoulder harness may be adjustable to the height of the user to accommodate the length of the trunk of the individual. The user selects the desired weight to attach to the rotatable weight support member. The user can position and secure the rotatable weight support member to the desired angle which moves and maintains the weight a desired distance from the body to increase or decrease the change in the center of gravity which stresses the body muscles in different ways. The user wears the backpack for exercise programs including a treadmill, walking, hiking, stair climber, elliptical, aerobic conditioning class or other suitable exercise regime.

Figure 3:
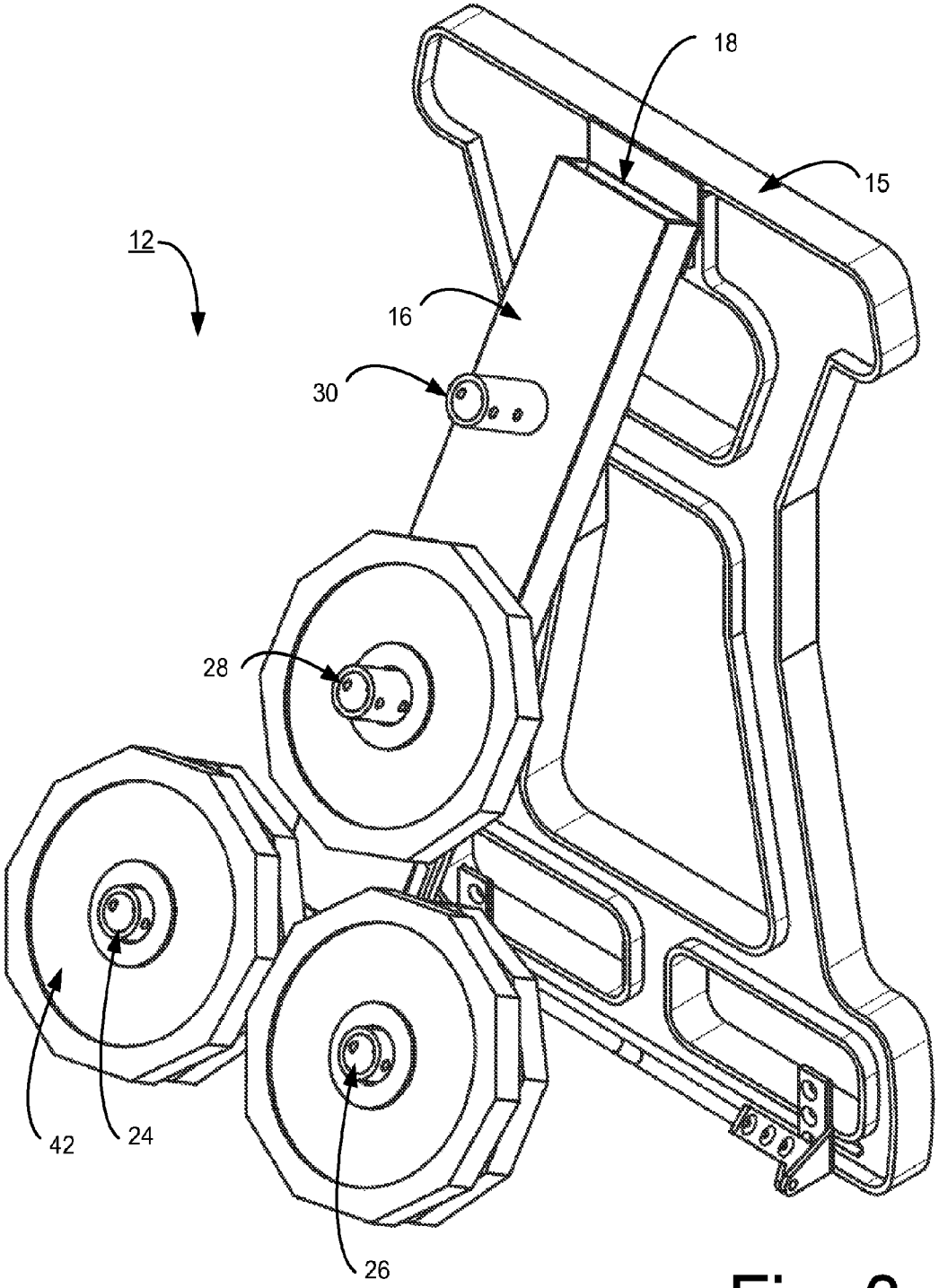
FIG. 3 provides an isometric view of the frame including a rotatable weight support member and a rotatable bar support sub-assembly of an implementation hereof.

In the depiction of the of the frame sub-assembly in FIG. 3, a rotatable weight support member 16 is shown disposed on the rotatable weight support member 16 by top hinge 18, which is fastened to the frame element 15 of sub-assembly 12. It may be noted that this rotatable connection is at or near the top of frame 15; however, it could be at the bottom (see e.g., FIG. 8 described further below), or at another location. The rotatable weight support member 16 may be rotated on the rotatable weight support member top hinge 18 to different positions (not shown in FIG. 3, but see FIGS. 4, 6 and 7). The rotatable weight support member hereby allows the weight to be positioned at different distances and/or angles from the body. As shown in FIGS. 7*a* and 7*b* alternative angles and thus distances may be provided, one alternative in FIG. 7*b* and two in 7*a* (support arms are shown in dashed lines in FIG. 7*a*). The weight attaching members 24, 26, 28 and 30 are disposed of on the rotatable weight support member 16. The weight attaching members 24, 26, 28, and 30 allow for the loading of weight. Weighted plates 42 are slid in to place on the weight attaching members 24, 26, 28, and 30. Increased weight or increased distance from the back creates increased muscular demand. The weights may be variable in size as for example in increments of 5 pounds, 5, 10, 15, or otherwise.

Figure 4:
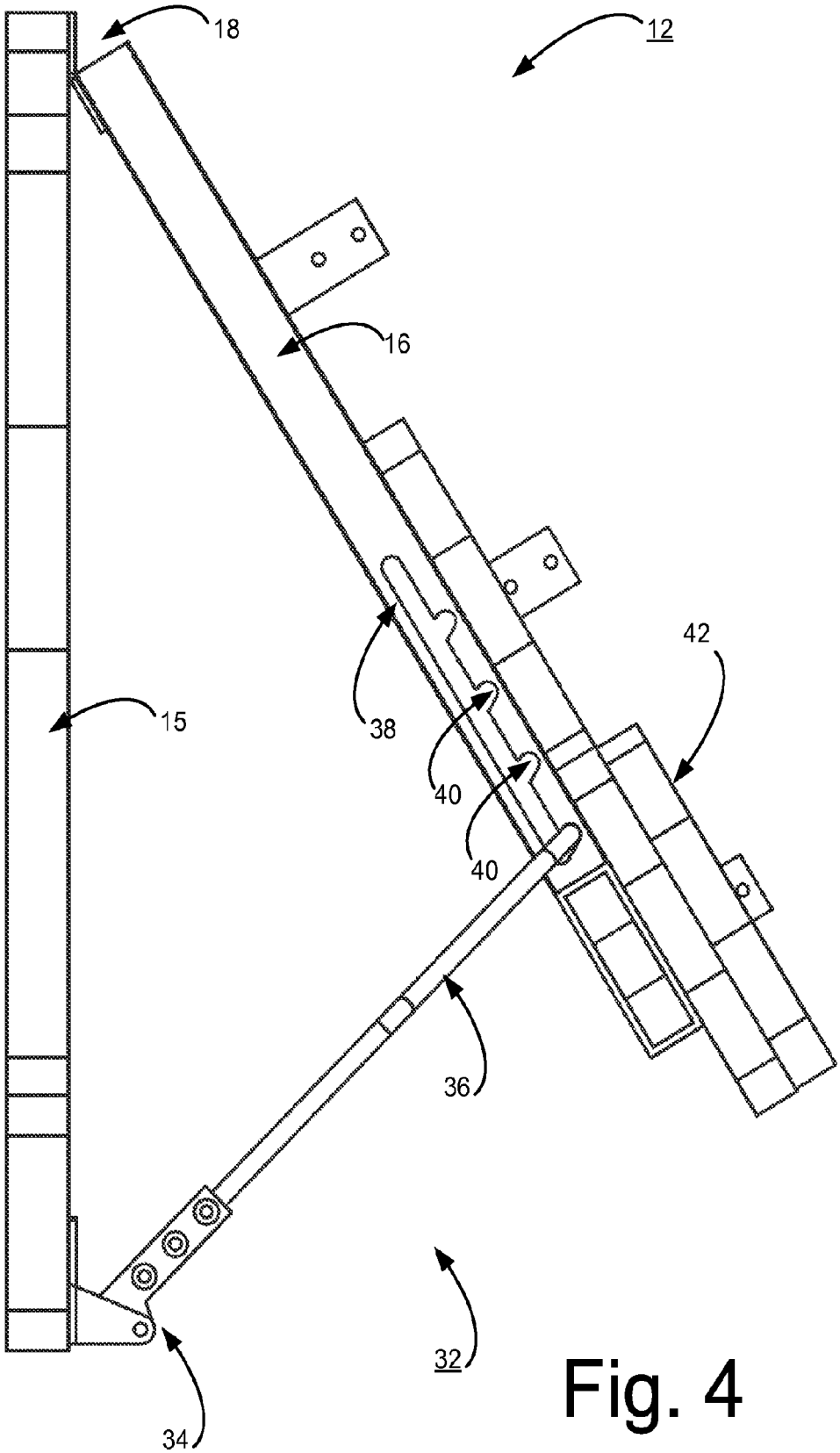
FIG. 4 provides a side elevational view of the frame including the rotatable weight support member and the rotatable bar support sub-assembly.

In a preferred embodiment as shown in FIG. 4, a rotatable weight support member 16 can be supported by a bar support sub-assembly 32 which in this version is a rotatable sub-assembly. This sub-assembly includes a support hinge 34 and a first support bar 36 and a second support bar 38 (support bar 38 is not shown in FIG. 4, but see FIG. 5). In this the support bar may be U-shaped or the support bar may be two discrete individual bars 36 and 39, see FIG. 5, that are inserted into the elongated slots (The bottom of the U-shape may be fixed or attached to the frame 15 or upside down and in the weight supporting member 16). The support bars 36 and 39 can be positioned to hold the rotatable weight support member 16 at different distances and at different angles from the user's body. The support bar 36 has one end disposed at the support hinge 34 and other end of the support bar is disposed of in the elongated slot 38. (In an alternative embodiment, not shown, only one support bar is connected to only one hinge at the base of the frame, with the other end disposed in the elongated slot.) In an implementation hereof according to FIG. 4, the elongated slot 38 may possess one or more or a series of notches 40. The notches 40 allow the rotatable weight support member 16 to be positioned and secured at a determined distance and angle from the frame 15. The support bar 36 may also create or provide a transfer of force of the positioned weight to the user's body at a desirable body location so that the user's muscles must counter the force in order to maintain balance.

Figure 5:
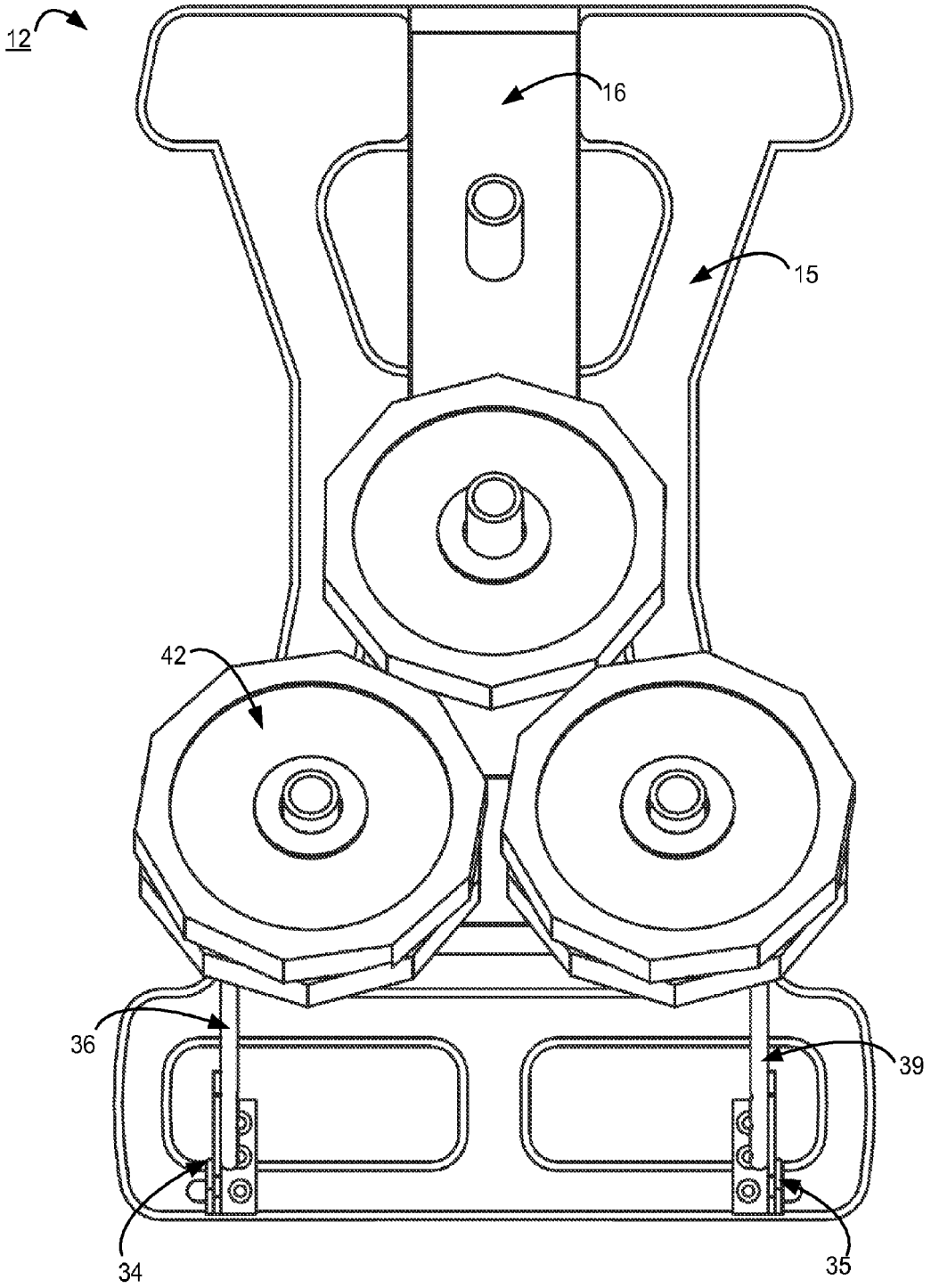
FIG. 5 provides a rear elevational view of the frame including the rotatable weight support member, and the rotatable bar support sub-assembly.

FIG. 5 shows both support bars 36 and 39. In this both bars are in an extended position such as that shown in FIGS. 2, 3 and 4, and are holding the rotatable support member 16 off of the frame 15. Additionally, FIG. 5 shows support hinge 35 that is located on the opposite side of base frame assembly 12 from support hinge 34 which was shown and described relative to FIG. 4.

Figure 6:
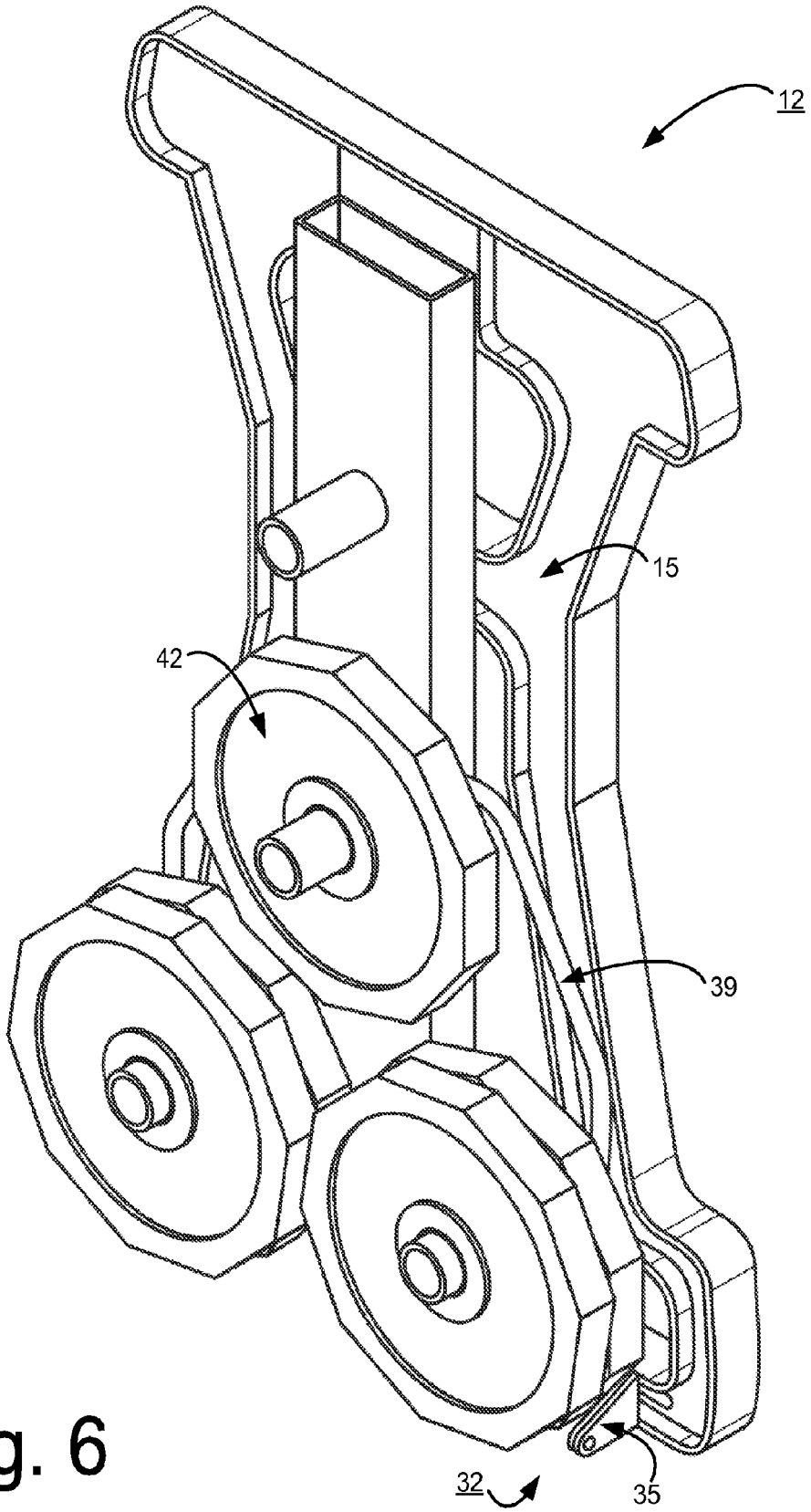
FIG. 6 provides an isometric view of a frame including a rotatable weight support member and a rotatable bar support sub-assembly in a collapsed position.

In FIG. 6, the frame sub-assembly 12 is shown with the support bar 36 in a retracted position and the rotatable support bar-assembly 32 collapsed in toward and adjacent the frame sub-assembly 12. In this position the distance D from FIG. 2 has been greatly reduced, and although still useful, is less so than a further extended position of the weight 42 away from the frame 15.

As introduced above, a variety of alternative structures may implement the apparatuses hereof. Structures described herein may come in different forms. Thus the frame sub-assembly may be constructed differently or be adapted differently to the overall weighted backpack assembly. Moreover, though structures have been shown and described in some detail herein, the scope and content hereof is not so limited, and instead may include alternative structures. Still furthermore, the connection mechanisms hereof are illustrative only as well, and not limitative of the scope and content hereof. Other connection mechanisms may be used to the same or substantially the same effect and thus be covered hereby.

As introduced above, a variety of alternative structures may implement the apparatuses hereof. As shown in FIGS. 8*a* and 8*b*, in an alternative, the weight support member 16 can be rotatable from the bottom of frame 15 and can thus move away from the user's body from the shoulders rather than the waist. As such it may be or may appear that the whole assembly is upside down, e.g., frame 15 up-turned and hinge 18 at the bottom. Note, it may be that there is no actual hinge, but rather for example a leaved fold out member not unlike that found in expandible brief cases. Note, also, that the members disposing the weight at a distance from the body may be static and not expandable or collapsible. Such an incarnation is shown in FIG. 9, which has the weight 42 disposed at a distance from the frame 15. One or more bars may be used for this, as for example the shown, extension bar 16*a* which may be used alone or with another member or bar 16*b*, which also may be used alone or with bar 16*a*. In the implementation of FIG. 9, it may be that there is no variability, as for example in FIG. 9*a*, fixed weight, fixed distance and the like; however, it also may just be the amount of weight is variable, as for example shown by the dashed line weights 42*a* in FIG. 9*b*. This version has been found interesting with the weight 12 inches from the body (see the table, Table 1, below Additional weight attaching members could be disposed on the rotatable weight support member. The weights could slide into packs that are attached to the rotatable weight support member instead of sliding on to weight attaching members.). The weights could slide into packs that are attached to a rotatable member or a static posterior positioned bar. The weight alternative could be in the form of weighted tubes or flat member that slide in to sleeves or pockets (see pockets 30*a* in FIG. 10; pockets 30*a* could be round or flat depending upon the weights to be used) fitted for the tubes or flats as opposed to weight plates that fit on the weight attaching members. Additionally, an additional apparatus could hold the entire rotatable weight support member which could be enclosed to use for storage of other items. The weights could be chambers to be filled by the user with sand or water. Additionally, the entire rotatable weight support member could be enclosed for use of a water dispensing apparatus by the user.

Apparatuses hereof may be made by any of a variety of materials. In many instances, a polymer may be the most likely material for the frame sub-assembly. The backpack sub-assembly may be made from cloth and foam and may have reinforced stitching. The backpack sub-assembly may also be made from canvas, nylon, or leather. Metal or other suitably hard material may form the weight supporting members, hinges, and weight supporting members. Shapes and sizes are not limited to those shown and described here either, as sizes and shapes may be selected to adapt to any of many alternative structures.

The assembly for attaching to a user may be a backpack (typically without pockets, though could be weight bearing pouches as shown in FIG. 10) as shown in FIG. 1, or the assembly may be such as to otherwise strap or connect to a user's body. One or more straps 20 may be used; a single strap such as a bike messenger bag strap; or strap wrapped around the torso; or, two or more straps, as in two shoulder straps, and/or an abdominal belt or like connection device 22. These may be connected to a back pack body portion 21 as in FIG. 1, or may be more directly connected to the frame 15 as shown or indicated by FIG. 11.

EXAMPLE

Methods

In this study, the weighted backpack was tested at multiple weights in several movement conditions. The heavy pack (35 lbs), light pack (17 lbs), control weighted pack (17 lbs), and unweighted control were worn during normal walking, incline walking, upstairs walking, and downstairs walking. Subjects were instructed to maintain a self-moderated steady walking pace in an upright position for all trials. The electrical activity, EMG, data was collected on the tibialis anterior, vastus lateralis, gluteus medius, external obliques, and rectus abdominus. EMG was measured by pre-amplified Ag/AgCl surface electrodes (Noraxon, Scottsdale, Ariz.) with a wireless transmitter (Noraxon, Scottsdale, Ariz.) and collected on a Dell notebook PC via a data acquisition card (DAQ-card) and an analog-to-digital (A/D) converter (Noraxon, Scottsdale, Ariz.). During each testing condition, all muscles were recorded simultaneously. Each electrode was 3.8 cm in diameter, with an inter-electrode spacing of 20 mm. Amplification of each EMG signal was set to maximum resolution to eliminate as much artifacts as possible. EMG channels were sampled at 2000 Hz. For each trial, subjects were recorded for three successive complete gait cycles, and EMG amplitude data was calculated over time period. The raw EMG was filtered, rectified, and smoothed using the RMS algorithm and a 100 ms window. Specifically, EMG signals were filtered with a 10 Hz Butterworth high-pass filter to remove electrode artifacts, rectified and smoothed based on the root-mean-square calculation with Myoresearch XP software. Peak and average EMG amplitudes were exported and compared to the control values in Excel to report a percent change (% change) relative to the control.

Results: see Table 1, below:

TABLE 1

| Weighting Condition | Movement Condition | Muscle | Birgit Peak EMG (uV) | Average EMG (uV) | Trevor Peak EMG (uV) | Average EMG (uV) | Jules Peak EMG (uV) | Average EMG (uV) | Averages Peak | Average |
|---|---|---|---|---|---|---|---|---|---|---|
| Control | Flat Walking | Tibialis Anterior | 153 | 41.7 | 194 | 85.8 | | | 173.5 | 63.75 |
| | | Vastus Lateralis | 36 | 16 | 47.5 | 12.5 | | | 41.75 | 14.25 |
| | | Gluteus Medius | 53.6 | 13.9 | 22.4 | 6.52 | | | 38 | 10.21 |
| | | External Obliques | 14.7 | 8.01 | 18.6 | 10.2 | | | 16.65 | 9.105 |
| | | Rectus Abdominus | 10.7 | 5.65 | 19.4 | 8.29 | | | 15.05 | 6.97 |
| Control | Incline Walking | Tibialis Anterior | 148 | 49.5 | 179 | 94.4 | | | 163.5 | 71.95 |
| | | Vastus Lateralis | 74 | 19.1 | 79.9 | 19.7 | | | 76.95 | 19.4 |
| | | Gluteus Medius | 94 | 18.3 | 19.3 | 7.14 | | | 56.65 | 12.72 |
| | | External Obliques | 19.5 | 9.39 | 19.9 | 9 | | | 19.7 | 9.195 |
| | | Rectus Abdominus | 13.7 | 6.09 | 19.8 | 7.12 | | | 16.75 | 6.605 |
| Control | Upstairs Walking | Tibialis Anterior | 146 | 51.2 | 369 | 129 | | | 257.5 | 90.1 |
| | | Vastus Lateralis | 198 | 50.7 | 276 | 70.6 | | | 237 | 60.65 |
| | | Gluteus Medius | 119 | 32.3 | 87.8 | 26.2 | | | 103.4 | 29.25 |

TABLE 1-continued

| Weighting Condition | Movement Condition | Muscle | Birgit Peak EMG (uV) | Average EMG (uV) | Trevor Peak EMG (uV) | Average EMG (uV) | Jules Peak EMG (uV) | Average EMG (uV) | Averages Peak | Average |
|---|---|---|---|---|---|---|---|---|---|---|
| | | External Obliques | 18.2 | 10 | 19.5 | 11.6 | | | 18.85 | 10.8 |
| | | Rectus Abdominus | 18.3 | 7.55 | 20.5 | 8.94 | | | 19.4 | 8.245 |
| Control | Downstairs Walking | Tibialis Anterior | 130 | 34.5 | 235 | 75.4 | | | 182.5 | 54.95 |
| | | Vastus Lateralis | 124 | 35.1 | 109 | 44 | | | 116.5 | 39.55 |
| | | Gluteus Medius | 39.9 | 13.7 | 25.1 | 7.86 | | | 32.5 | 10.78 |
| | | External Obliques | 20.1 | 9.16 | 18.6 | 9.95 | | | 19.35 | 9.555 |
| | | Rectus Abdominus | 11.8 | 5.88 | 21.5 | 8.35 | | | 16.65 | 7.115 |
| Normal Backpack | Flat Walking | Tibialis Anterior | 113 | 42.4 | 186 | 80.5 | | | 149.5 | 61.45 |
| | | Vastus Lateralis | 51.5 | 16.3 | 48 | 13.4 | | | 49.75 | 14.85 |
| | | Gluteus Medius | 61.9 | 16.1 | 20.5 | 6.93 | | | 41.2 | 11.515 |
| | | External Obliques | 19.9 | 11.2 | 17.1 | 9.92 | | | 18.5 | 10.56 |
| | | Rectus Abdominus | 15.2 | 6.92 | 20.7 | 8.1 | | | 17.95 | 7.51 |
| Normal Backpack | Incline Walking | Tibialis Anterior | 172 | 44.9 | 196 | 79.9 | | | 184 | 62.4 |
| | | Vastus Lateralis | 53.5 | 19.3 | 123 | 21.6 | | | 88.25 | 20.45 |
| | | Gluteus Medius | 112 | 26.1 | 29.4 | 7.86 | | | 70.7 | 16.98 |
| | | External Obliques | 21.3 | 10.4 | 19 | 10 | | | 20.15 | 10.2 |
| | | Rectus Abdominus | 13.7 | 6.83 | 18.9 | 7.23 | | | 16.3 | 7.03 |
| Normal Backpack | Upstairs Walking | Tibialis Anterior | 150 | 45.4 | 292 | 112 | | | 221 | 78.7 |
| | | Vastus Lateralis | 204 | 56 | 233 | 65.7 | | | 218.5 | 60.85 |
| | | Gluteus Medius | 99.2 | 36.4 | 87.7 | 19.6 | | | 93.45 | 28 |
| | | External Obliques | 21.4 | 11.1 | 19.1 | 11.2 | | | 20.25 | 11.15 |
| | | Rectus Abdominus | 14.5 | 7.63 | 19.9 | 9.06 | | | 17.2 | 8.345 |
| Normal Backpack | Downstairs Walking | Tibialis Anterior | 141 | 20.6 | 191 | 44.9 | | | 166 | 32.75 |
| | | Vastus Lateralis | 77.7 | 34 | 150 | 52 | | | 113.85 | 43 |
| | | Gluteus Medius | 46.4 | 14.9 | 65.4 | 9.5 | | | 55.9 | 12.2 |
| | | External Obliques | 30.9 | 12.4 | 20.1 | 8.97 | | | 25.5 | 10.685 |
| | | Rectus Abdominus | 15.5 | 7.38 | 20.1 | 8.15 | | | 17.8 | 7.765 |
| Light Pack | Flat Walking | Tibialis Anterior | 148 | 55.5 | 201 | 94.1 | | | 174.5 | 74.8 |
| | | Vastus Lateralis | 131 | 43.7 | 62.4 | 13.8 | | | 96.7 | 28.75 |
| | | Gluteus Medius | 75.6 | 18.1 | 40.8 | 10.3 | | | 58.2 | 14.2 |
| | | External Obliques | 32.1 | 18.5 | 19.1 | 11.5 | | | 25.6 | 15 |
| | | Rectus Abdominus | 16 | 7.43 | 23.9 | 9.62 | | | 19.95 | 8.525 |
| Light Pack | Incline Walking | Tibialis Anterior | 90 | 34.9 | 254 | 100 | | | 172 | 67.45 |
| | | Vastus Lateralis | 614 | 67.4 | 113 | 23.9 | | | 363.5 | 45.65 |
| | | Gluteus Medius | 91.3 | 24.4 | 35.3 | 9.85 | | | 63.3 | 17.125 |
| | | External Obliques | 25.1 | 12 | 18.7 | 9.95 | | | 21.9 | 10.975 |
| | | Rectus Abdominus | 18.6 | 7.71 | 20.2 | 8.39 | | | 19.4 | 8.05 |

TABLE 1-continued

| Weighting Condition | Movement Condition | Muscle | Birgit Peak EMG (uV) | Average EMG (uV) | Trevor Peak EMG (uV) | Average EMG (uV) | Jules Peak EMG (uV) | Average EMG (uV) | Averages Peak | Average |
|---|---|---|---|---|---|---|---|---|---|---|
| Light Pack | Upstairs Walking | Tibialis Anterior | 134 | 51 | 319 | 126 | | | 226.5 | 88.5 |
| | | Vastus Lateralis | 819 | 108 | 248 | 65.4 | | | 533.5 | 86.7 |
| | | Gluteus Medius | 114 | 37.1 | 74.5 | 18.3 | | | 94.25 | 27.7 |
| | | External Obliques | 26.5 | 11.9 | 18.7 | 11 | | | 22.6 | 11.45 |
| | | Rectus Abdominus | 16.8 | 8.05 | 18.8 | 9.38 | | | 17.8 | 8.715 |
| Light Pack | Downstairs Walking | Tibialis Anterior | 211 | 38.1 | 169 | 58.9 | | | 190 | 48.5 |
| | | Vastus Lateralis | 146 | 49.4 | 155 | 60.7 | | | 150.5 | 55.05 |
| | | Gluteus Medius | 49.7 | 17.8 | 34.1 | 10.9 | | | 41.9 | 14.35 |
| | | External Obliques | 52.4 | 20.9 | 23.6 | 9.99 | | | 38 | 15.445 |
| | | Rectus Abdominus | 26.8 | 10.8 | 20.5 | 9.97 | | | 23.65 | 10.385 |
| Heavy Pack | Flat Walking | Tibialis Anterior | 173 | 57 | 223 | 78.6 | | | 198 | 67.8 |
| | | Vastus Lateralis | 330 | 57 | 69.5 | 15.4 | | | 199.75 | 36.2 |
| | | Gluteus Medius | 97.9 | 25.5 | 20.1 | 5.83 | | | 59 | 15.665 |
| | | External Obliques | 96 | 54.3 | 33.7 | 17.7 | | | 64.85 | 36 |
| | | Rectus Abdominus | 28.1 | 14.8 | 33.5 | 14.9 | | | 30.8 | 14.85 |
| Heavy Pack | Incline Walking | Tibialis Anterior | 132 | 34 | 216 | 93 | | | 174 | 63.5 |
| | | Vastus Lateralis | 279 | 53.4 | 164 | 29.5 | | | 221.5 | 41.45 |
| | | Gluteus Medius | 110 | 25.9 | 38.1 | 9.35 | | | 74.05 | 17.625 |
| | | External Obliques | 84.9 | 41.6 | 27.6 | 13.5 | | | 56.25 | 27.55 |
| | | Rectus Abdominus | 19.7 | 13.2 | 25.9 | 12.3 | | | 22.8 | 12.75 |
| Heavy Pack | Upstairs Walking | Tibialis Anterior | 162 | 52.9 | 333 | 131 | | | 247.5 | 91.95 |
| | | Vastus Lateralis | 243 | 76.9 | 374 | 77.8 | | | 308.5 | 77.35 |
| | | Gluteus Medius | 123 | 33.7 | 101 | 22.1 | | | 112 | 27.9 |
| | | External Obliques | 111 | 44.6 | 33.1 | 14.6 | | | 72.05 | 29.6 |
| | | Rectus Abdominus | 29.8 | 17.9 | 38.5 | 13.9 | | | 34.15 | 15.9 |
| Heavy Pack | Downstairs Walking | Tibialis Anterior | 130 | 34.2 | 167 | 55.4 | | | 148.5 | 44.8 |
| | | Vastus Lateralis | 199 | 62.7 | 176 | 53.1 | | | 187.5 | 57.9 |
| | | Gluteus Medius | 60.1 | 16.1 | 28.8 | 9.57 | | | 44.45 | 12.835 |
| | | External Obliques | 105 | 60.1 | 29.8 | 15.1 | | | 67.41 | 37.6 |
| | | Rectus Abdominus | 44.6 | 21.2 | 36.5 | 15.1 | | | 40.55 | 18.15 |

Overall, wearers of the backpack had higher EMG values compared to the control conditions. These differences were the greatest under the greatest load. For example, even during flat walking, subjects had around 240% greater peak EMG and 233% average EMG activation in the external obliques and 182% greater peak EMG and 142% greater average EMG on the rectus abdominus in the heavy pack condition compared to the control condition.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope.

Accordingly, what is claimed is:

1. An off-set weighted exercise apparatus which includes:

a base frame assembly attachable to a strap assembly having a shoulder strap with a top and a bottom for connection to a user, the base frame assembly including a base frame;

a weight support member connected to the base frame and disposed to maintain a weight or other application of force at one or both an extended or increased distance D from the base frame; and, one or both:

at least one support bar connected to the base frame and connectable to the weight support member to support the weight support member; or, wherein the weight support member is an angularly disposed weight support member angularly connected to the base frame;

wherein the one or both an extended or increased distance D creates a difference in the effective operational center of gravity relative to the center of gravity that would have been provided by the weight had the weight been in a position adjacent the base frame a non-extended or non-increased distance therefrom; and, wherein the one or both an extended or increased distance D creates a difference in the weight application, as a torque within the apparatus between the upper portion and the lower portion, or between the top of the shoulder strap and the bottom of the shoulder strap.

2. An off-set weighted exercise apparatus according to claim 1 wherein the strap assembly is a backpack assembly.

3. An off-set weighted exercise apparatus according to claim 1 wherein the weight support member is disposed in a fixed position relative to the base frame.

4. An off-set weighted exercise apparatus according to claim 1 wherein the weight support member is attached to the base frame at one or both of the top and the bottom of the base frame.

5. An off-set weighted exercise apparatus according to claim 1 wherein the weight support member is an angularly disposed weight support member angularly connected to the base frame.

6. An off-set weighted exercise apparatus according to claim 1 further comprising:

at least one fixed arm connecting the weight support member to the base frame.

7. An off-set weighted exercise apparatus according to claim 1 which further includes:

at least one support bar connected to the base frame and connectable to the weight support member to support the weight support member.

8. An off-set exercise apparatus according to claim 1 wherein the at least one support bar is fixedly connected to the base frame.

9. An off-set exercise apparatus according to claim 1 further comprising: at least one fixed arm connecting the at least one support bar to the base frame.

10. An off-set exercise apparatus according to claim 1 wherein the weight support member is an angularly disposed weight support member.

11. An off-set exercise apparatus according to claim 10 wherein the weight support member includes at least one location to which the at least one support bar can attach.

12. An off-set exercise apparatus according to claim 10 wherein said weight support member includes at least one elongated slot which contains at least one notch that allows the at least one support bar to be positioned at an angular disposition relative to the base frame.

13. An off-set exercise apparatus according to claim 12 wherein the at least one notch secures the support bar in a desired position.

14. An off-set exercise apparatus according to claim 1 wherein said weight support member includes at least one weight attaching member.

15. An off-set exercise apparatus according to claim 14 wherein the at least one weight attaching member is a rearwardly projecting cylinder of standardized size to hold at least one standardized size weight plate.

16. An off-set exercise apparatus according to claim 15 wherein the at least one weight attaching member allows the weighted member to be secured in place.

17. An off-set exercise apparatus according to claim 14 wherein the at least one weight attaching member comprises at least one storage compartment that is receivable of at least one standard size weight, wherein said at least one storage compartment comprises a front wall, and a back wall.

18. An off-set weighted backpack comprising:

a base frame, the base frame including:

a weight support member connected to the base frame to support weight one or both an extended or increased distance D therefrom;

wherein the one or both an extended or increased distance D creates a difference in the effective operational center of gravity relative to the center of gravity that would have been provided by the weight had the weight been in a position adjacent the base frame a non-extended or non-increased distance therefrom; and, wherein the one or both an extended or increased distance D creates a difference in the weight application, as a torque within the base frame between the upper portion and the lower portion, or between the top of the strap and the bottom of the strap;

at least one support bar connected to the base frame and connected to the weight support member; and, one or both:

wherein the at least one support bar is connectable to the weight support member to support the weight support member; or, wherein the weight support member is an angularly disposed weight support member angularly connected to the base frame;

a backpack assembly to which the base frame is connectable, the backpack assembly including:

a body portion to which the base frame is connectable; and, at least one strap connected to the body portion for securing the backpack assembly to a user's torso.

19. An off-set weighted backpack according to claim 18 further comprising:

at least one angularly fixed member connecting the weight support member to the base frame;

at least one angularly fixed member connecting the at least one support bar to the base frame.

* * * * *